US006075953A

United States Patent [19]

Kida et al.

[11] Patent Number: 6,075,953

[45] Date of Patent: Jun. 13, 2000

[54] IMAGE FORMING APPARATUS SUPPORTING SYSTEM

[75] Inventors: Akihiko Kida; Naoto Okazaki, both of Kanagawa-ken, Japan

[73] Assignee: Kabushiki Kaisha Toshiba, Kawasaki, Japan

[21] Appl. No.: 09/132,491

[22] Filed: Aug. 11, 1998

[30] Foreign Application Priority Data

Aug. 11, 1997 [JP] Japan ..... 9-216621

[51] Int. Cl.[7] ..... G03G 15/00

[52] U.S. Cl. ..... 399/8; 399/10

[58] Field of Search ..... 399/8, 11, 79, 399/80, 81, 10

[56] References Cited

U.S. PATENT DOCUMENTS

| | | | |
|---|---|---|---|
| 4,799,081 | 1/1989 | Kikuno et al. | 399/11 |
| 5,218,406 | 6/1993 | Ebner | 399/11 |
| 5,243,382 | 9/1993 | Takano et al. | 399/8 |
| 5,303,005 | 4/1994 | Takano et al. | 399/8 |
| 5,343,276 | 8/1994 | Yamashita et al. | 399/8 |
| 5,677,775 | 10/1997 | Yamaguchi et al. | 358/468 |

FOREIGN PATENT DOCUMENTS 4-42165 2/1992 Japan .

*Primary Examiner*—Robert Beatty
*Attorney, Agent, or Firm*—Foley & Lardner

[57] ABSTRACT

An image forming apparatus supporting system includes a first control unit to perform a series of controls relative to the main body that performs the image forming operation; a program storage memory connected to the first control unit via an address bus and a data bus; a non-volatile memory to store maintenance data relative to the main body and an interface circuit that enables the interface between the non-volatile memory and an external device. Further, this system includes a second control unit that controls the main body so that maintenance data can be transmitted from a non-volatile memory to the external device via the interface circuit according to input/output items designated by the external device when the first control unit is not performing the control of the image forming operation in the main body.

9 Claims, 8 Drawing Sheets

IMAGE FORMING APPARATUS SUPPORTING SYSTEM

BACKGROUND OF THE INVENTION

1. Field of the Invention

The present invention relates to an image forming apparatus supporting system that is provided with an interface device between an image forming apparatus and an external device and, more particularly, to an image forming apparatus supporting system that is usable for maintenance, adjustment, etc. of an image forming apparatus.

2. Description of the Related Art

As well known, in order to facilitate the maintenance and adjustment of such electronic equipment as OA (Office Automation) equipment requiring maintenance and adjustment irrespective of image forming apparatus, a dedicated terminal device or such an external device as a notebook-sized personal computer is connected to applicable equipment.

In this case, as external devices, there have been available fewer devices for general purpose use and equipment relative to facilities, and those provided with a connecting terminal have been mainly used.

As described above, in order for external devices to cope with such mass-produced general use products such as an image forming apparatus, it is necessary to add such dedicated devices as control elements, a microcomputer, etc. for communication with external devices at the image forming apparatus side.

However, to add a dedicated device, a microcomputer, etc. to an image forming apparatus, there is such a problem that a cost of the entire image forming apparatus will increase.

On the other hand, to avoid the cost increase resulting from the addition of such a microcomputer for the purpose of dedicated communication control, a microcomputer for controlling the main unit of an image forming apparatus is designed so that it also performs the communication control. In this case, a load applied on a microcomputer that is controlling an image forming apparatus will increase as it is required to control the main body of an image forming apparatus and the communication with an external device. As a result, a problem occurs in that the original function as an image forming apparatus tends to be lost.

Further, when considering a communication protocol with an external device, for instance, when a command (code) of data required by an external device is received by an image forming apparatus, after translating the received code, required data is prepared and transmitted to the external device.

In general, in case of an image forming apparatus available in multiple kinds of uses, a storage location of required data differs normally according to each kind of apparatus in order to prevent the flexibility of a program from being degraded.

Therefore, it does not become possible to make a series of communication control programs in the modular configuration, and it becomes necessary to develop a series of communication control programs whenever required. Thus, from the viewpoint of cost and maintenance of program quality, there are problems.

Further, as data demands to an image forming apparatus by external devices occupy the majority of communication, there is such a problem that much time is needed for each translation of command codes.

SUMMARY OF THE INVENTION

The present invention is an object to provide an image forming apparatus supporting system that is capable of facilitating the support of evaluation, maintenance, repair, etc. of the image forming apparatus by acquiring required data by connecting an external device thereto and processing them or by giving instructions to facilitate the evaluation, maintenance, repair, etc. by connecting an external device when performing the evaluation, maintenance, repair, etc. of an image forming apparatus and equipped with an interface device between an image forming apparatus and an external device to prevent the generation of problems from the viewpoint of cost, quality and time.

According to the present invention, an image forming apparatus supporting system is provided. This image forming apparatus supporting system comprises first control means for performing a series of controls relative to a main body that performs an image forming operation; program storage means connected to the first control means via an address bus and a data bus for storing a program; non-volatile storage means for storing maintenance data relative to the main body; an interface circuit that enables the interface between the non-volatile storage means and an external device; and second control means for controlling the main body so that maintenance data can be output from the non-volatile storage means to the external device according to input/output items designated by the external device when the first control means is not controlling the image forming operation in the main body.

DETAILED DESCRIPTION OF THE PREFERRED EMBODIMENTS

Hereinafter, a preferred embodiment of the present invention will be described with reference to the attached drawings.

Figure 1:
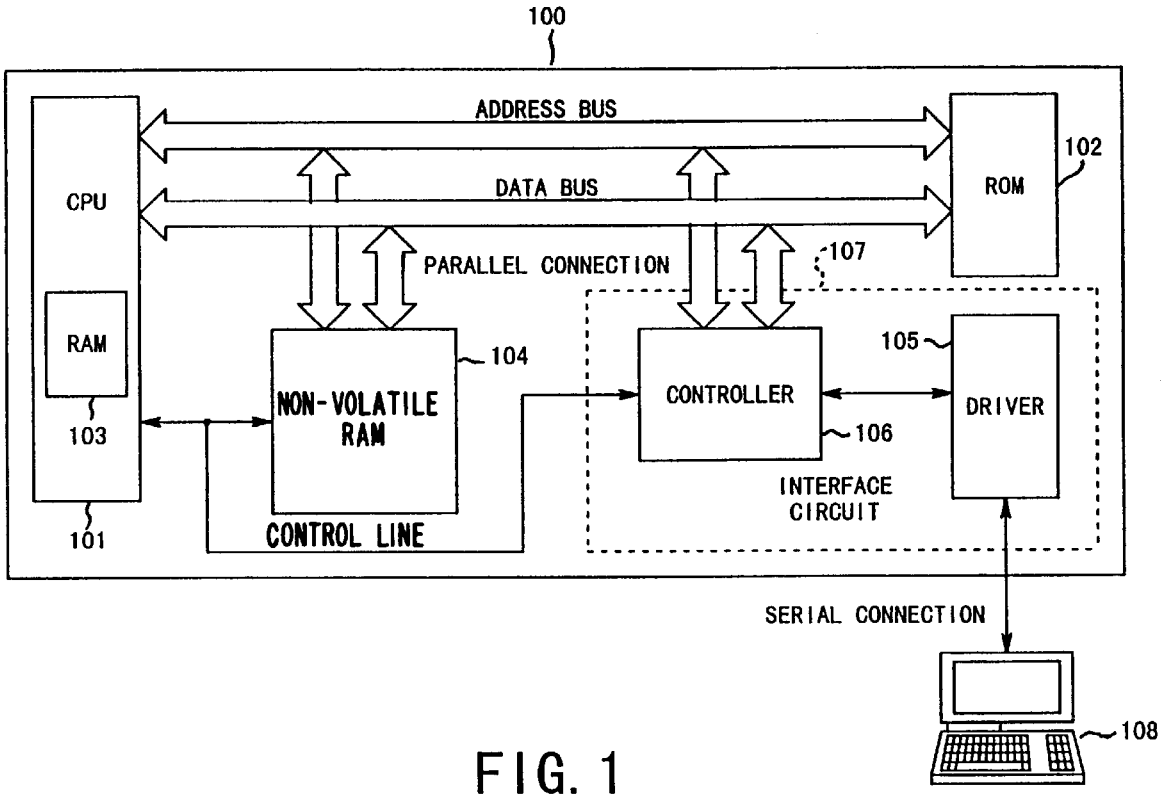
FIG. 1 is a schematic block diagram showing an embodiment of an image forming supporting system of the present invention.

FIG. 1 schematically shows the entire structure of an image forming apparatus supporting system including an interface circuit provided between an image forming apparatus and an external device.

That is, this image forming apparatus supporting system is composed of a main body 100 of an image forming apparatus and an external device 108 serially connected to the main body 100. The external device 108 may be a personal computer, for example.

The main body 100 is provided with a CPU 101 that is a microcomputer, a ROM 102, a RAM 103, a non-volatile RAM 104 and an interface circuit 107.

The CPU 101 performs a series of controls relative to the main body 100 of the image forming apparatus.

The ROM 102 is connected to the CPU 101 via an address bus and a data bus, and stores programs of the CPU 101.

The RAM 103 is used as a work area of data for the CPU 101.

The non-volatile RAM 104 stores maintenance data relative to the main body 100 of the image forming apparatus.

The interface circuit 107 is provided with a controller 106 that is a parallel/serial conversion element enabling the serial interface with peripheral equipment; for instance, Toshiba TMP8251, and a driver 105 connected to the controller 106, for instance, RS232C.

The external device 108 that is a personal computer, etc., is serially connected to the driver 105 in the interface circuit 107.

The non-volatile RAM 104 and the controller 106 are connected in parallel with the address bus and the data bus.

Between the non-volatile RAM 104 and the controller 106, a control line is connected.

Next, the control steps required for transmitting maintenance data to the external device 108 from the RAM 103 and the non-volatile RAM 104 in the main body 100 via the interface circuit 107 or for inputting maintenance data to the RAM 103 and the non-volatile RAM 104 from the external device 108 via the interface circuit 107 in the image forming apparatus supporting system in a structure shown in FIG. 1 will be described.

The maintenance data referred to here are composed of about 100 adjusting values; for instance, the quantity of light of an exposure lamp, amount of aligning for adjusting the leading edge of paper, priority of paper feed cassette, a paper roller exchange timing, counter values of number of copies, etc.

This image forming apparatus supporting system has the control for starting the communication application.

Figure 2:
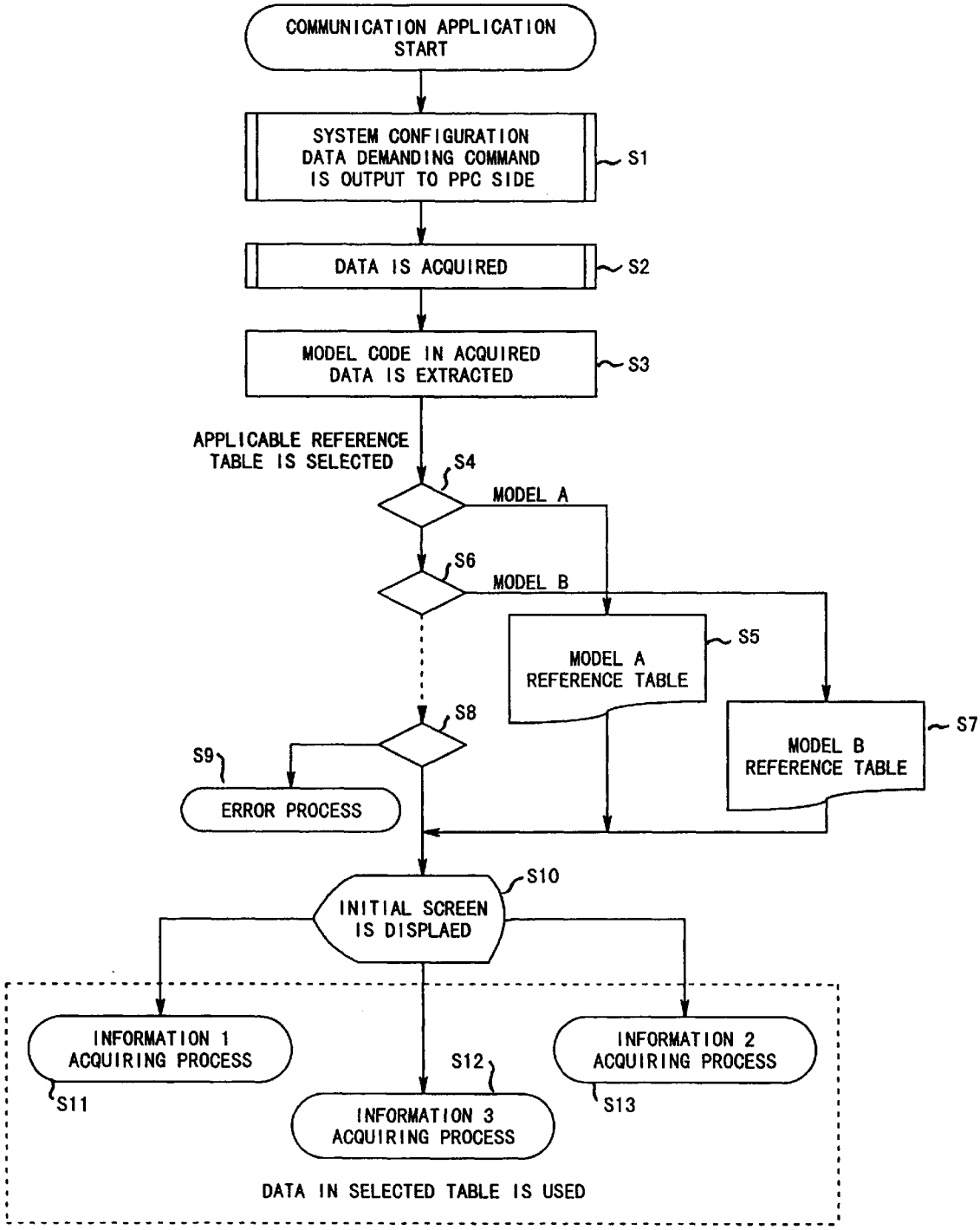
FIG. 2 is a flowchart for explaining the communication application starting process of the image forming apparatus supporting system shown in FIG. 1.

The start of this communication application will be described referring to a flowchart shown in FIG. 2.

First, the external device 108 acquires the system configuration data by outputting the system configuration data requesting command to the main body 100 via the interface circuit 107 (STEP S1 and STEP S2).

Then, the external device 108 extracts the equipment code in the acquired system configuration data (STEP S3) and selects a file as a reference table applicable to the extracted equipment code (STEPS S4–S7).

The maintenance data configuration and the maintenance data table by each model for transmitting maintenance data for a plurality of image forming apparatus are collected in one file for each model and pre-stored in the external device 108.

Then, when the communication with an image forming apparatus starts and the system configuration data is received, the model of that image forming apparatus is determined. When the model of an image forming apparatus is determined, a file corresponding to that model is read out and according to the data contained in the file read out, the maintenance data is exchanged and the maintenance data received from the image forming apparatus is collected and managed by referring to the previously prepared data table.

Figure 3:
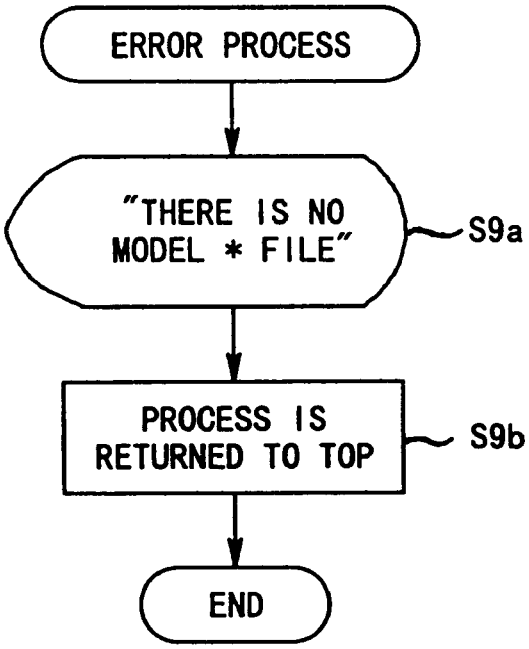
FIG. 3 is a flowchart for explaining the error process in the communication application starting process of the image forming apparatus supporting system shown in FIG. 2.

If no equipment code could be extracted in STEP 8, the error process is executed (STEP S9). The error process in STEP 9 is executed as shown in the flowchart in FIG. 3. That is, after displaying that there exists no applicable equipment file, the process returns to the top step and is restarted (STEPS S9*a* and S9*b*).

Then, the initial screen corresponding to the selected reference table is displayed (STEP S10) and using data contained in the selected table, the processes to acquire the information 1, 2 and 3 definitely shown below are executed (STEPS S11–S13).

Then, the image forming apparatus supporting system judges the output demand data from the top address data and byte length data (a command set) received from the external device 108 via the interface circuit 107 and performs the control for executing the output operation from the main body 100.

Figure 4:
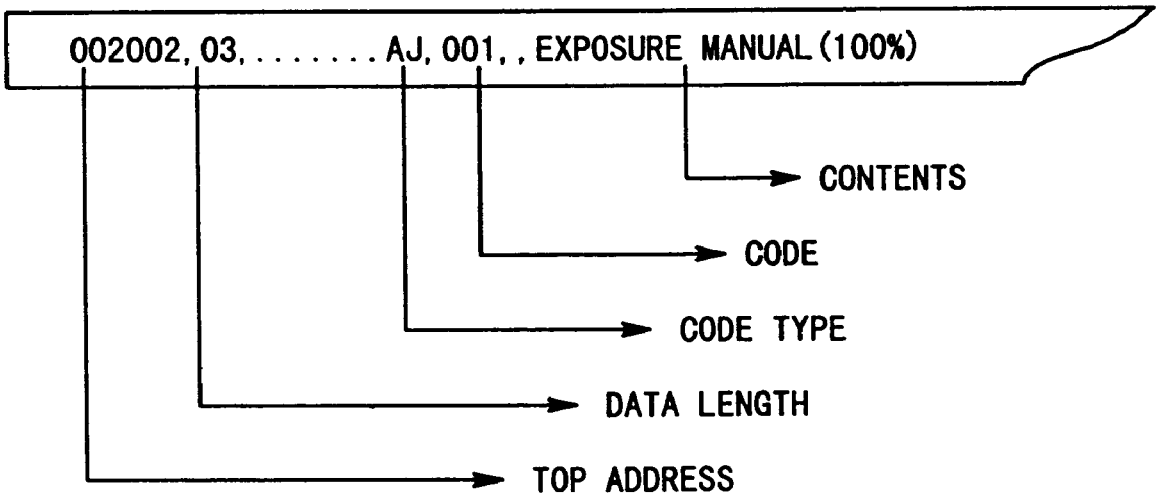
FIG. 4 is a diagram for explaining a reference map that is used by an external device of the image forming apparatus shown in FIG. 1.

For instance, if the external device 108 desired to obtain an exposure output adjusting value of "Manual Exposure" in the adjusting mode in this embodiment, the external device 108 refers to the reference map shown in FIG. 4 for demand data corresponding to "Manual Exposure" on the reference map shown in FIG. 4 and according to this, writes a demand data of "002002,03" into the demand description column and executes the communication process. That is, the demand data referred to here are the top address and data length of the data demanded from the external device 108.

Figure 5:
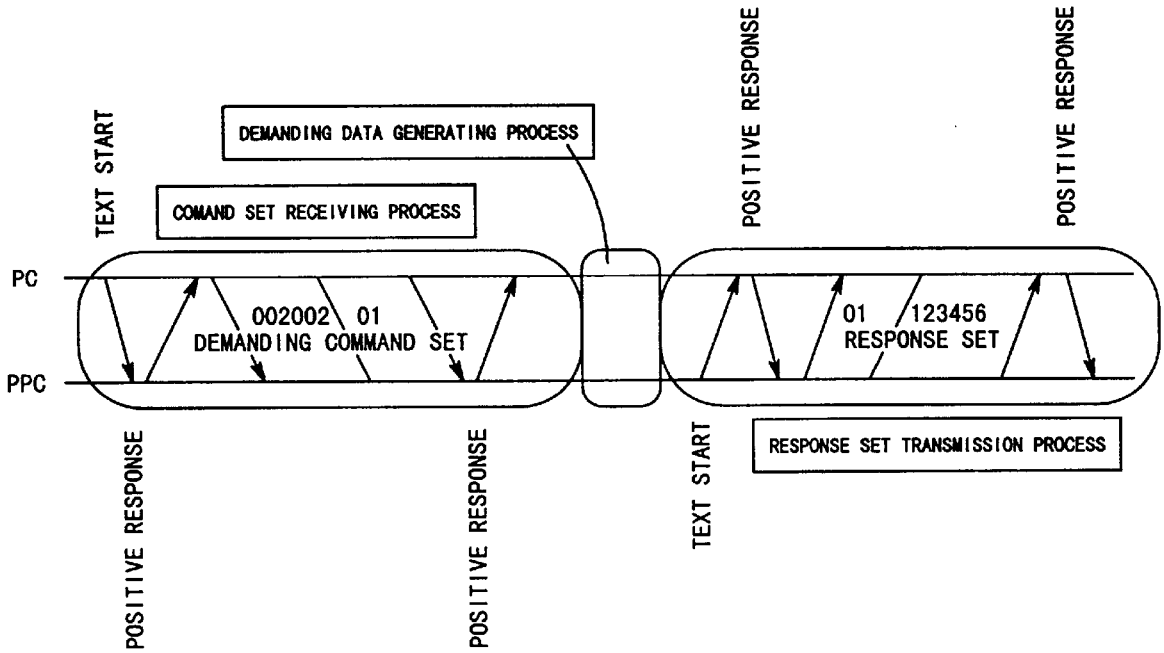
FIG. 5 is a diagram for explaining the communication steps between the image forming apparatus and the external device in the image forming apparatus supporting system shown in FIG. 1.
Figure 6:
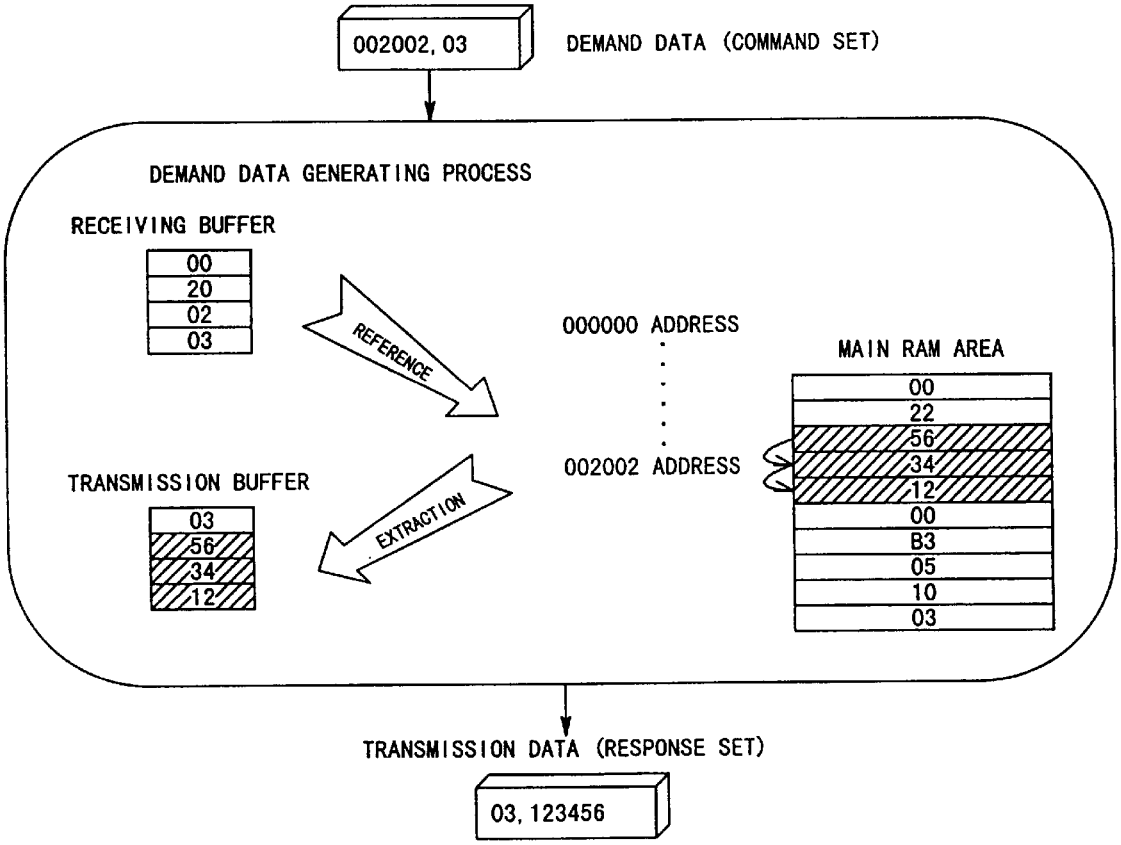
FIG. 6 is a diagram for explaining a reference map that is used by an external device of the image forming apparatus supporting system shown in FIG. 1.

In compliance with this, the main body 100 of the image forming apparatus starts to execute the communication process program assuming that a text start command was received in a receiving buffer via the interface circuit 107 as shown in FIG. 5 and FIG. 6. By extracting data for 3 byte length containing the address 002002 as the top address of the non-volatile RAM 104 sequentially from the contents of the demand data, the main body 100 generates a transmission data "03,123456" in the transmission data storage area (the transmission buffer) and performs the process to return this generated data to the external device 108.

Further, this image forming apparatus supporting system restricts input/output items for the external terminal device 108 via the interface circuit 107 according to the state of the main body 100. According to this restriction, the control for not impeding the operation of the main body 100 is carried out.

In this embodiment, the judgement is made at multiple points of time in the communication process program.

Figure 7:
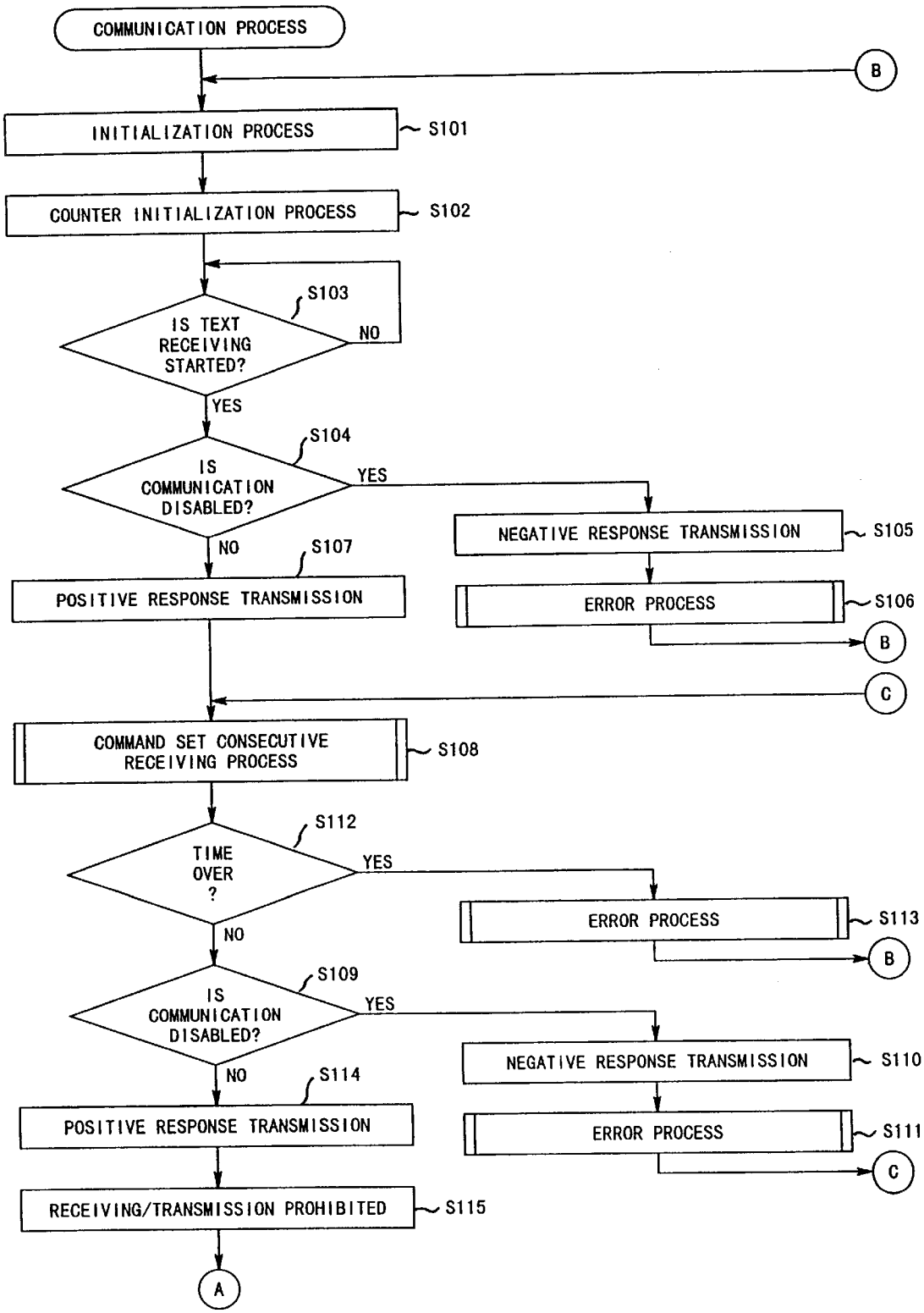
FIG. 7 is a flowchart for explaining the input/output process in the main body of the image forming apparatus of the image forming apparatus supporting system shown in FIG. 1.
Figure 8:
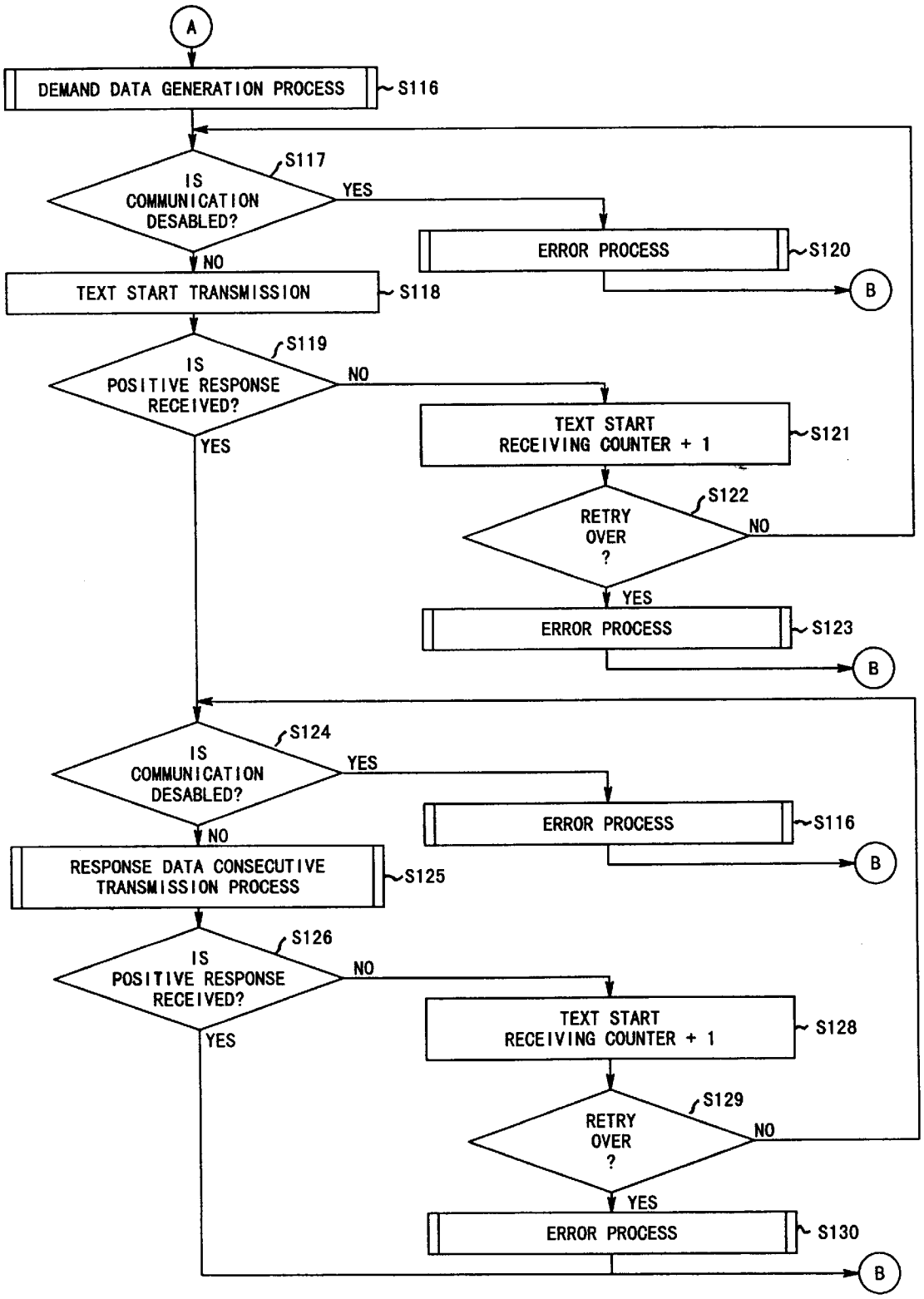
FIG. 8 is a flowchart for explaining the input/output process in the main body of the image forming apparatus of the image forming apparatus supporting system shown in FIG. 1.

Hereinafter, the input/output process and the error process relative to the main body 100 will be described referring to the flowcharts shown in FIG. 7 and FIG. 8.

(1) Judgement at the text starting time:

First, when a text start command is transmitted from the external device 108, the main body 100 performs various initialization processes via the interface circuit 107 (STEPS S101 and S102) and in succession, judges whether the text receiving is started (STEP S103). After making this judgement, it is judged whether the current self-operating status is the communication impossible state (STEP S104). If it is in the communication impossible state, for instance, in the copy mode (the copying operation) and the like, a negative response command is transmitted to the external device 108 (STEP S105). After transmitting this negative response command, the error process is executed (STEP S106) and returning to the top of the communication process, awaits the receiving of the text start command again.

(2) Judgement after continuous command set receiving:

First, when a text start command is received from the external device 108 via the interface circuit 107, the main body 100 transmits a positive response command if it is in the state able to communicate (STEP S107) in STEP S104. Thereafter, the main body 100 executes the continuous receiving process of command set (STEP S108). When completing this continuous receiving process, the main body 100 judges the own operating state; that is, whether it is in the communication disabled state (STEP S109). When the main body 100 is in the communication disabled stated, it transmits the negative response command to the external device 108 (STEP S110). Thereafter, the main body 100 executes the error process (STEP S111) and returning to the top of the continuous receiving process, waits the receiving of the command sets again. Here, however, the main body 100 judges whether more than a fixed time passed (STEP S112). In case of a time over, the main body 100 executes the error process (STEP S113) and after this error process, returns to the top of the communication process and waits again the receiving of the test start command.

(3) Judgement after requested data generating process:

First, when the text start command is received from the external device 108, the main body 100 transmits a positive response command (STEP S114) if it is in the state able to communicate in STEP S109 and after transmitting the positive response command, prohibits the receiving/transmission (STEP S115). After this prohibition, from the contents of the continuously received command sets, data actually stored in the RAM 103 and the non-volatile RAM 104 are extracted and data to be returned are generated (STEP S116).

After completing these data extraction and the data generating process, the main body 100 judges the own operating state; that is, whether it is disabled to communicate (STEP S117) and if it is able to communicate, transmits the text start (STEP S118). Then, judging whether a positive response was received against this text start (STEP S119) and if the communication is not possible, the error process is executed (STEP S120) and returning to the top of the communication process, waits the receipt of the text start command again.

Further, when judging whether the positive response was received against the text start transmitted in STEP S119, if a positive response was received, the process proceeds to the next STEP S124. If no positive response was received, the text start receiving counter is incremented by one (+1) (STEP S121) and whether the retry was over is judged (STEP S122). When the retry was over, the error process is executed (STEP S123) and the process returns to the top of the communication process. If the process was not over, the process returns to STEP S117.

(4) Judgement before response data transmission process:

First, when a text start command was transmitted from the external device 108, the main body 100 judges its own operating state; that is, whether it is disabled to communicate in STEP S124 if the positive response was received when judging the receipt of the positive response against the text start transmitted in STEP S124. If it is able to communicate, the main body 100 executes the response data continuous transmission process (STEP S125) and it is judged whether the positive response was received against the response data continuous transmission (STEP S126). If the communication is disable, the error process is executed (STEP S127) and returning to the top of the communication process, waits the receipt of the text start command again.

Further, if the positive response was received when judging the response against the response data continuous transmission (STEP S126), the process returns to the top of the communication process and the receipt of the text start command is waited again. However, if no positive response was received, the text start receiving counter is incremented by one (+1) (STEP S128) and it is judged whether the retry was over (step S129). If the retry was over, executing the error process (STEP S130), the process returns to the top of the communication process. If the retry was not over, the process returns to STEP S124.

Figure 9:
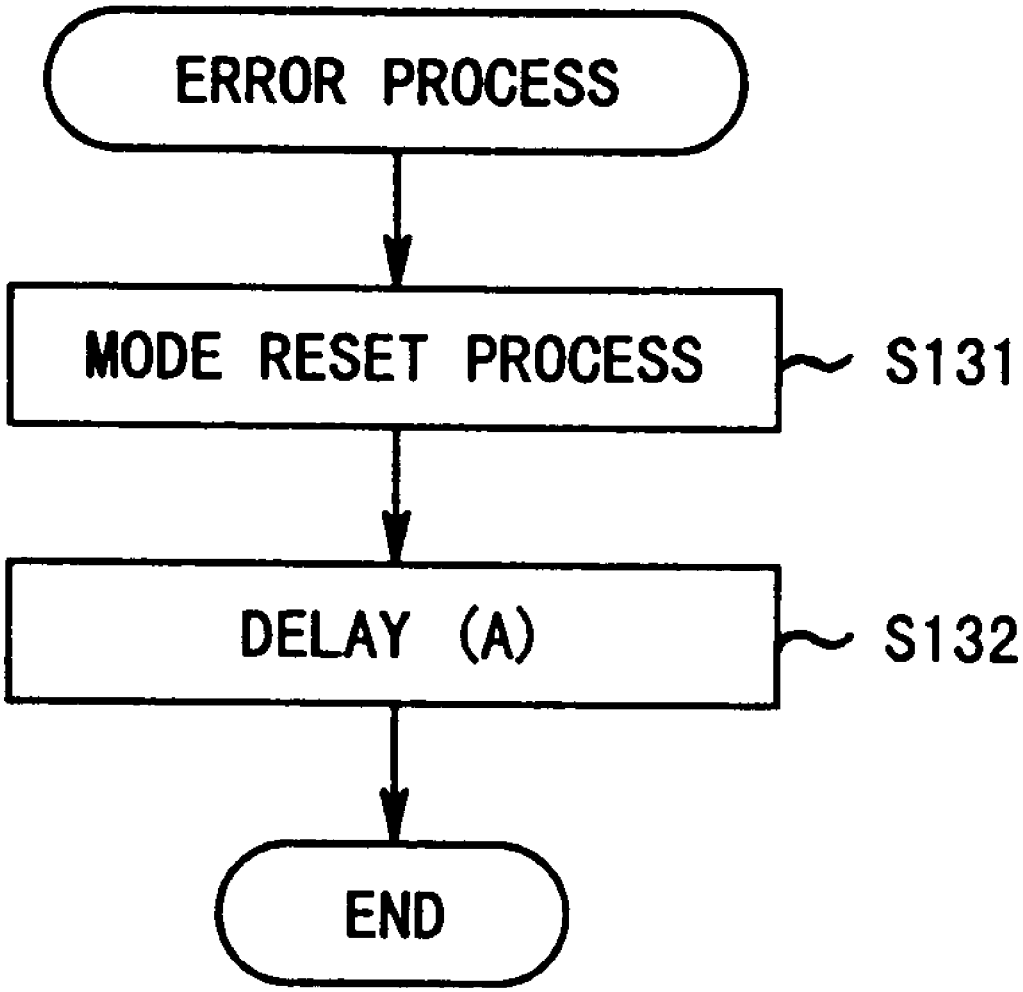
FIG. 9 is a flowchart for explaining the error process in the input/output process in the main body of the image forming apparatus of the image forming apparatus supporting system shown in FIG. 7 and FIG. 8.

(5) Error process:

In the error process described above, the mode shifting flag reset process is executed (STEP S131) and the time to return to the top of the transmission process is waited by a delay time A (STEP S132) as shown in FIG. 9.

(6) Process at the external device 108 side:

Judging the interruption of the communication with the main body 100 (in the delay time A), the external device shifts to the error process, notifies a user of the error generation and executes the process urging the user to execute the communication again.

Thus, according to the present invention, it is possible to realize an image forming apparatus supporting system capable of supporting the evaluation, maintenance and repair of an image forming apparatus by connecting an external device, extracting required data from an image forming apparatus and processing them when performing the evaluation, maintenance and repair of an image forming apparatus.

Further, according to the present invention, it is possible to realize an image forming apparatus supporting system capable of supporting the evaluation, maintenance and repair of an image forming apparatus by connecting an external device, providing instructions for facilitating the evaluation, maintenance and repair of an image forming apparatus.

Further, according to the present invention, it is possible to realize an image forming apparatus supporting system capable of facilitating the development of programs relative to equipment interchangeability at cheap cost without impeding the original image forming work of image forming apparatus even when an external device for facilitating its maintenance and adjustment.

That is, according to the present invention, it is possible to realize an image forming apparatus supporting system that is able to rewrite copy modes, adjusting values, customer data, etc. in the non-volatile RAM 104 by providing such maintenance information as various adjusting values, service information, etc. to the external device 108 from the non-volatile RAM 104 via the serial line.

This image forming apparatus supporting system is capable of protecting the impediment of the image forming work in the main body of the image forming apparatus by restricting input/output items according to the state of the main body of the image forming apparatus (for instance, at the time of copying, standby, set-up, adjustment, data extraction, maintenance) when inputting/outputting maintenance information such as copy mode, various adjusting values, service information, customer information, etc.

Further, this image forming apparatus support system is capable of controlling the execution of the output operation by judging the output demanding data according to a top address data and a byte length data from the external device when outputting maintenance information such as copy mode, adjusting values, customer information, service information, etc. from the non-volatile RAM 104 of the main body of an image forming apparatus via the serial line.

Further, this image forming apparatus supporting system is capable of transmitting a signal that the communication is started from the main body of an image forming apparatus in the communication between the main body of the image forming apparatus and an external device via the serial line.

Further, this image forming apparatus supporting system is capable of transmitting a signal that the communication is started from an external device in the communication between an image forming apparatus and an external device via the serial line.

Further, this image forming apparatus supporting system is capable of retaining data at the main body side until the communication is properly completed and clearing the data at the main body side after the communication is completed properly in the communication between the main body of an image forming apparatus and the external device via the serial line.

Further, this image forming apparatus supporting system is capable of retaining data in the main body until the communication is properly completed and moving the data in another storage area and retaining the data there after the communication is properly completed.

Further, the present invention contains the following concepts:

(1) A concept relative to the communication protocol for the top address of stored data and data length in the data communication.

(2) Transmission data is generated when receiving the top address storing required data and a data length.

In this case the data length address is updated.

(3) In the communication between the main body of an image forming apparatus and an external device via the serial line, when data is demanded to the main body by an external device, the main body receives the top address of a required data area wherein data are stored by the external device and a data length extending over multiple consecutive addresses and stores in the received data temporary storage area B together with the top address of applicable data.

Next, an address data of the top address added with one (1) is stored in the temporary storage area B.

The work to store applicable address data with one (1) added to this address in the storage area is repeated for the data length.

Then, all data in the temporary storage areas are processed and transmitted to an external device.

Further, the concepts of the present invention shown above contain the actions and effects shown below:

(1) In the data communication, as the communication is permitted or prohibited according to the state of the main body of an image forming apparatus, it is possible to prevent the original image forming process of the main body from being impeded.

(2) A memory area is secured for constantly supervising the state of the main body of an image forming apparatus and the permission/prohibition is judged according to that information, and a priority is given to the process relative to the image formation or the communication when an error is generated.

(3) A memory area is secured for constantly supervising the state of the main body of an image forming apparatus and the communication permission/prohibition state is judged according to that information.

In this case, the information in the memory is rewritten constantly by the control relative to the main body of an image forming apparatus.

Further, if a process relative to the communication is generated, this memory area is checked at the communication control side (the communication control module: program) and if the communication is not permitted, the error process is executed.

Therefore, as described above in detail, when performing the evaluation, maintenance and repair of an image forming apparatus, the present invention enables to facilitate such the works by obtaining and processing information from an image forming apparatus or providing instructions for facilitating such the works by connecting an external device to the image forming apparatus. Accordingly, it is possible to provide an image forming apparatus that has an interface device between the main body of the image forming apparatus and an external device so as not to cause any problem with respect to a cost, quality and time viewpoint.

What is claimed is:

1. An image forming apparatus supporting system comprising:

first control means for performing a series of controls relative to a main body that performs an image forming operation;

program storage means connected to the first control means via an address bus and a data bus for storing a program;

non-volatile storage means for storing maintenance data relative to the main body;

an interface circuit that provides an interface between the non-volatile storage means and an external device; and second control means, provided within the interface circuit, for controlling the main body so that the maintenance data can be output from the non-volatile storage means to the external device according to input/output items designated by the external device when the first control means is not controlling the image forming operation in the main body.

2. An image forming apparatus supporting system according to claim 1, wherein the external device includes a personal computer that is serially connected to the main body.

3. An image forming apparatus supporting system according to claim 1, wherein the maintenance data is at least one of light quantity of an exposure lamp, an aligning amount of paper for adjusting the leading edge position, a feed paper cassette using priority, a paper feed roller exchange timing and a counter value of the number of paper.

4. An image forming apparatus supporting system according to claim 1, wherein the second control means controls the main body so that maintenance data in the non-volatile storage means can be rewritten via the interface circuit according to the input/output items designated by the external device when the first control means is not controlling the image forming operation in the main body.

5. A method for supporting an image forming system including first control means for performing a series of controls relative to a main body that performs an image forming operation, program storage means connected to the first control means via an address bus and a data bus for storing a program, non-volatile storage means for storing maintenance data relative to the main body, and an interface circuit that enables the interface between the non-volatile storage means and the external device, the method comprising the steps of:

a first step to transmit a top address of a specified data area and a length of data extending over multiple consecutive addresses to the main body from the external device;

a second step wherein the main body stores the top address and data of applicable data received in a first temporary storage area based on the data received in the first step;

a third step wherein the main body stores data of an address that is the top address added with one (1) in a second temporary storage area;

a fourth step wherein the main body stores the applicable data of address that is the top address added with one (1) and further added with one (1) in the second temporary storage area; and a fifth step wherein the data stored in the first and the second temporary storage area are processed and transmitted to the external device after repeating the second through the fourth steps for the above-mentioned data length.

6. An image forming apparatus supporting system comprising:

a main CPU to perform a series of controls relative to a main body that performs an image forming operation;

a ROM connected to the main CPU via an address bus and a data bus to store a program;

a non-volatile RAM to store maintenance data relative to the main body;

an interface circuit that provides an interface between the non-volatile RAM and an external device; and a controller provided within the interface circuit to control the main body so that the maintenance data can be output from the non-volatile RAM to the external device according to input/output items designated by the external device when the main CPU is not controlling the image forming operation in the main body.

7. An image forming apparatus supporting system according to claim 6, wherein the external device including a personal computer that is serially connected to the main body.

8. An image forming apparatus supporting system according to claim 6, wherein the maintenance data is at least one of light quality of an exposure lamp, an aligning amount of paper for adjusting a leading edge position, a usage priority value of a feed paper cassette, a paper feed roller exchange timing, and a counter value of a number of paper copies.

9. An image forming apparatus supporting system according to claim 6, wherein the controller controls the main body so that maintenance data in the non-volatile RAM can be rewritten via the interface circuit according to the input/output items designated by the external device when the main CPU is not controlling the image forming operation in the main body.

* * * * *